US006131236A

United States Patent [19]

Roth

[11] Patent Number: 6,131,236

[45] Date of Patent: Oct. 17, 2000

[54] WET CLEANING APPARATUS

[75] Inventor: Paul Roth, Isny, Germany

[73] Assignee: PROAIR GmbH Gerätebau, Germany

[21] Appl. No.: 09/280,795

[22] Filed: Mar. 26, 1999

[30] Foreign Application Priority Data

Mar. 27, 1998 [DE] Germany ..... 198 13 434

[51] Int. Cl.[7] ..... A47L 9/28

[52] U.S. Cl. ..... 15/319; 15/339

[58] Field of Search ..... 15/319, 339

[56] References Cited

U.S. PATENT DOCUMENTS

| | | | |
|---|---|---|---|
| 4,357,729 | 11/1982 | Vander Molen et al. | 15/319 |
| 4,958,406 | 9/1990 | Toyoshima et al. | 15/319 |
| 5,155,885 | 10/1992 | Jyouraku et al. | 15/319 |
| 5,276,939 | 1/1994 | Uenishi | 15/319 |
| 5,381,584 | 1/1995 | Jyoraku et al. | 15/319 |
| 5,881,430 | 3/1999 | Driessen et al. | 15/319 |

*Primary Examiner*—Robert J. Warden, Sr.
*Assistant Examiner*—Theresa T. Snider
*Attorney, Agent, or Firm*—Robert W. Becker & Associates

[57] ABSTRACT

A wet cleaning apparatus to which accessory devices can be attached has a suction blower and a control unit that automatically adjusts the power of the suction blower in accordance with the presence or absence of an accessory device or the operational state of an accessory device.

9 Claims, 3 Drawing Sheets

WET CLEANING APPARATUS

BACKGROUND OF THE INVENTION

The present invention relates to a wet cleaning apparatus that is equipped with a control unit to which accessory devices can be attached, e.g. an electric brush, a heating device, or the like, and is also equipped with a suction blower.

Wet cleaning apparatus are provided with a suction device consisting of a hose with a suction tube and a suction nozzle. Dirty air is being sucked in by the suction blower via the suction nozzle and is being guided via the suction tube and the suction hose through a liquid which, preferably, is water. The dust and dirt particles are being deposited in the liquid. In order to achieve an effective cleaning result on textile carpeting, an electric brush provided with an electrically driven brush roller is employed as an accessory device. Because of the increased amount of dust development that is caused by the use of the electric brush, it is necessary to turn the suction blower to the highest setting in order to reliably suck in the increased dust amount. Otherwise, a significant portion of the stirred up dust enters the air in a room. When the electric brush is turned off, the suction blower of the wet cleaning apparatus continues operating at full power, and, thereby, at its full noise level. If the electric brush is turned off, for example, in order to answer a telephone call, the high noise level of the suction blower is highly irritating.

It is an object of the invention to embody a wet cleaning apparatus of the aforementioned general type such that, when the accessory device is turned off, the remaining noise level is merely low, at the most.

SUMMARY OF THE INVENTION

The suction blower of the inventive wet cleaning apparatus is controlled in interrelation with the respective accessory device that is attached. For example, when the accessory device is turned off, the power output of the suction blower is automatically adjusted accordingly, i.e. decreased, so that the noise level caused by the suction blower is low. Advantageously, the power output of the suction blower will be decreased to a minimum, so that when the accessory device is turned off, a noise level is created that is extremely low and no longer annoying. Thus, for example, when cleaning with an electric brush, it is possible to turn the brush off temporarily in order to answer the phone. On turning off the accessory device, the power output of the suction blower is respectively decreased and the noise level of the suction blower is thereby largely reduced so that a telephone conversation can be held without any problem. When the accessory device is subsequently turned on again, the power output of the suction blower is automatically increased correspondingly so that the accessory device can be operated optimally.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
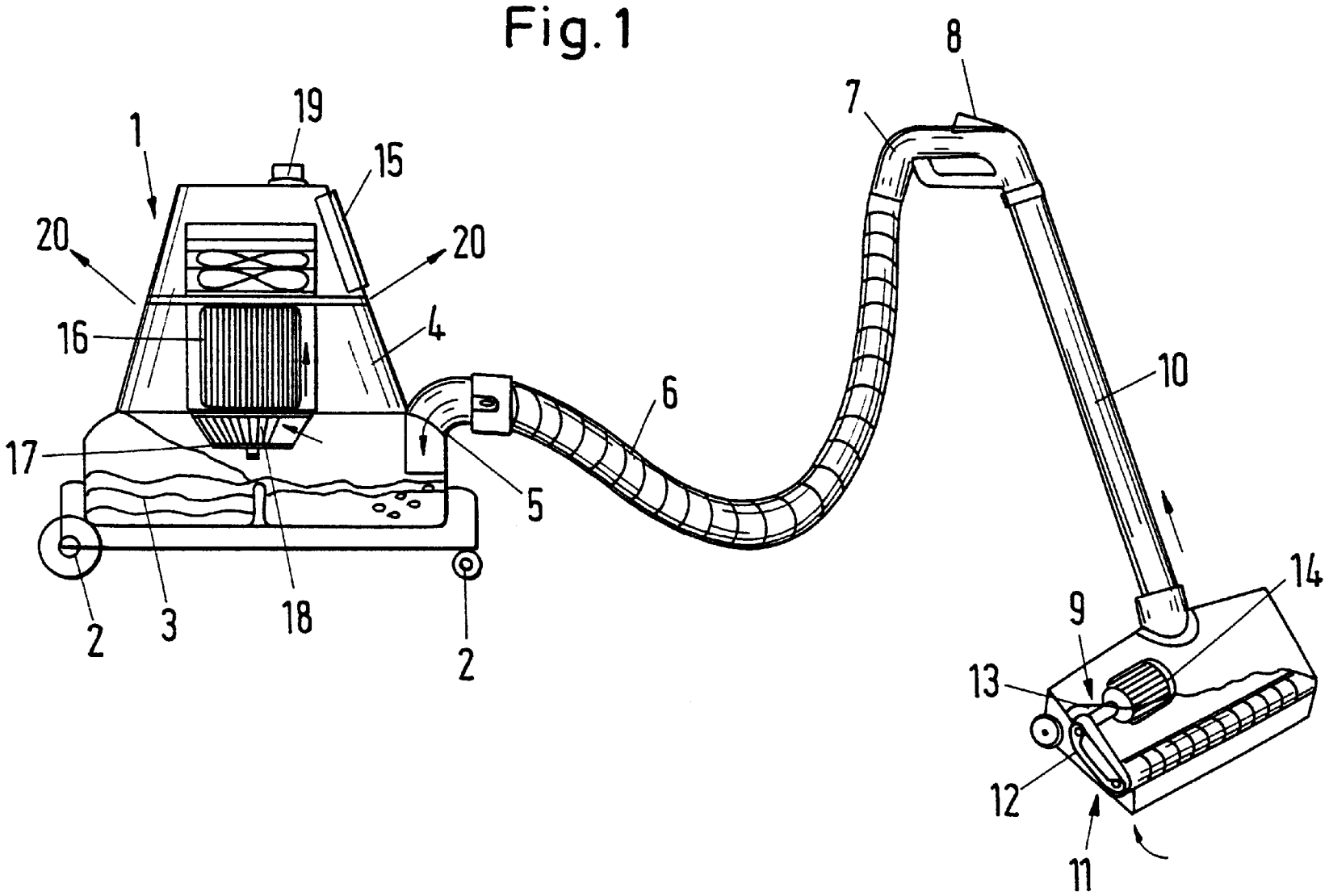
FIG. 1 shows a partially cross-sectional view of a wet cleaning apparatus with an electric brush being attached.

Referring now to the drawings in detail, the wet cleaning apparatus 1 illustrated in FIG. 1 is a liquid suction cleaning apparatus which travels on rollers 2. The rollers 2 can be directly attached at the wet cleaning apparatus 1. However, it is also possible to place the wet cleaning apparatus 1 on a stand that has rollers 2.

The wet cleaning apparatus 1 is provided with a water bath 3 through which the intake air is guided. A housing 4 of the wet cleaning apparatus 1 is provided with a connector 5 for a suction hose 6. The suction hose 6 is provided at its free end with a handle 7 that carries a handle switch 8. An electric brush 9 can be set in motion by the handle switch 8. A tube 10 is connected to the electric brush 9 and can be attached to the handle 7. The electric brush 9 is provided with a brush roller 11 which is drive-connected by a belt 12 to a drive shaft 13 of an electric motor 14. The electric motor 14 is connected to the handle switch 8 via non-represented wires and the handle switch 8, in turn, is connected to a control unit 15 of the wet cleaning apparatus 1 by non-represented wires.

The housing 4 houses the motor of the suction blower 16 that is provided with a vertical motor shaft 17 with a separator 18 fixedly attached thereto. The motor of the suction blower 16 can be turned on by a switch 19 positioned on top of the housing 4. The wet cleaning apparatus 1 is connected to the power supply by an electric cable that is not illustrated.

After turning the wet cleaning apparatus 1 on by actuating the switch 19, the apparatus is ready for operation. The person operating the apparatus has to actuate, e.g., for cleaning a carpet, the handle switch 8 at the handle 7 in order to turn on the electric brush 9. Via the electric motor 14, the brush roller 11 is rotatably driven and it loosens the dirt from the carpet so that it can be taken in by the suction stream. Via the tube 10 and the suction hose 6, the dirty air first reaches the water bath 3 in the direction of the arrow shown in FIG. 1. At the interior of the connector 5 of the housing 4, deflection devices can be provided by which the dirty intake air is forced to pass through the water bath 3. The separation of the dirt from the air occurs in the water bath 3. Dirt particles which are possibly still in the air and were not deposited in the water bath 3 are sucked in by the rotating separator which is designed in a known manner frusto-conically and is provided at its circumferential surface with evenly arranged perpendicular slots. After having been guided through the water bath 3, the air reaches the interior of the separator 18 via these slots. The fine particles still contained in the air are being separated from the air within the interior of the separator 18. The air then streams upwardly and exits the housing 4 in the direction of the arrows 20 through openings not illustrated in FIG. 1.

The wet cleaning apparatus 1 can be provided in addition to the separator 18 with a filter through which the air is forced to stream after having passed through the water bath 3. It is also possible to insert into the wet cleaning apparatus 1, instead of the separator 18, a filter as a separation means.

Especially dirt particles on textile carpets can be effectively sucked in by the electrically driven brush roller 11. The brush roller 11 causes an increased dust development. Therefore, it is necessary to turn the suction blower 16 to its highest power setting in order to reliably suck in the increased dust amount. Otherwise, a significant portion of the stirred up dust enters the air in a room.

The electric motor 14 of the electric brush 9 normally draws power via a connection at the motor of the suction blower 16 of the wet cleaning apparatus 1. The switch 19 for turning on the motor of the suction blower 16 does not necessarily have to be provided at the housing 4. It can also be provided at the handle 7 of the tube 10.

For actuating the electric brush 9, a contact switch (not illustrated) at the electric brush 9 may be employed instead of the handle switch 8. This contact switch is provided with a slantedly downwardly extending contact pin. This contact pin is designed and arranged such at the electric brush 9 that it turns the electric motor 14 on or off depending on the position of the tube 10. If the tube 10 is positioned vertically in its so-called resting position, the contact pin moves into such a position as to turn the electric motor 14 off. For the cleaning operation, the tube 10 is brought from the vertical position into a tilted position (operating position). Thereby, the contact pin is pivoted on contacting the surface to be cleaned and the electric motor 14 is turned on.

The control unit 15 of the wet cleaning apparatus 1 is designed such that the motor of the suction blower 16 is shut down or is, at least, adjusted to a lower rpm when the electric brush 9 is turned off. Thereby, it is accomplished that the motor of the suction blower 16 of the wet cleaning apparatus only operates at a high rpm and a corresponding noise level when the electrical brush 9 is actually in operation. When the electric motor 14 of the electric brush 9 is turned off, the motor of the suction blower 16 does not continue running at the high and noisy rpm. Therefore, for example, a telephone call can be answered during a cleaning break without an annoying noise level being present during a telephone conversation.

In the simplest embodiment, the motor of the suction blower 16 of the wet cleaning apparatus is shut down by the control unit 15 when the electric brush 9 is turned off. Conversely, the motor of the suction blower 16 is automatically turned on by the control unit 15 without having to actuate the switch 19 when the electric brush 9 is turned on. It is, however, also possible to decrease the rpm of the motor of the suction blower 16 to a preset rpm having only a low noise level when the electric brush 9 is turned off. Correspondingly, the rpm of the motor of the suction blower 16 is again increased to the maximum rpm when the electrical brush 9 is again actuated in order to be able to clean the surface properly by the electrical brush 9. By virtue of this embodiment, the usual sound level of the wet cleaning apparatus 1 is reduced by such an amount that, e.g., conversations or telephone calls without a noise irritation can be held when the electrical brush 9 is turned off.

Figure 2:
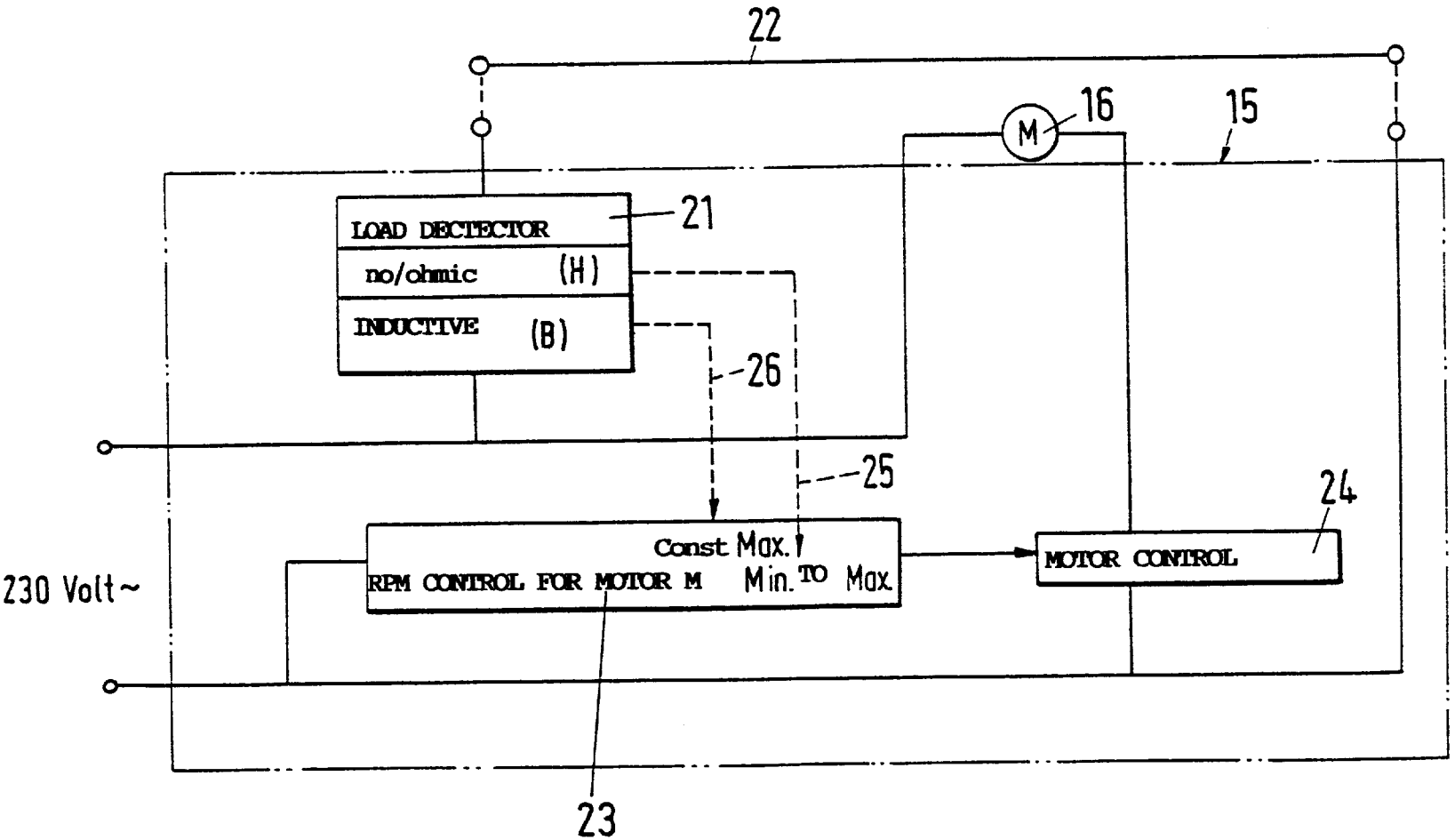
FIG. 2 shows a block diagram of an inventive control unit for the wet cleaning apparatus according to FIG. 1.

The control unit 15 (FIG. 2) is provided with a load detector 21 which, upon attaching an accessory device to the connector 5, is capable of determining easily, based on the drawing of current, which kind of accessory device is attached. Thereby, it is ensured that not only electrical brushes 9 can be attached to the connector 5 of the wet cleaning apparatus 1 but also known suction nozzles which are not provided with a motor of their own. The connector 5 is provided with a corresponding socket 22 to which the suction hose 6 of the respective device to be attached is connected. The external socket 22 can also be an additional socket at the housing 4 into which socket a corresponding connecting portion of the electric brush 9 can be inserted. The control unit 15 which is supplied with power from the electric network is provided with the load detector 21 which is positioned upstream of a speed control (rpm adjustment) 23 by which the rpm of the motor of the suction blower 16 can be adjusted. The load detector 21 transfers signals to the speed control 23, depending on the respectively attached device. The speed control 23 controls a motor control 24 for the motor of the suction blower 16.

If no device is attached to the connector 5 of the wet cleaning apparatus 1, the load detector 21 determines on turning the wet cleaning apparatus 1 on that no load is attached to the socket 22. Correspondingly, the load detector 21 sends signals 25 to the speed control 23. The rpm of the motor of the suction blower 16 can now, at the discretion of the user, be manually adjusted from minimum to maximum. The motor control 24 receives corresponding signals from the speed control 23.

Also, a heating device can be attached to the connector 5 of the wet cleaning apparatus 1, the heating device representing a resistive load. The load detector 21 is designed such that the signals 25 are also being sent to the speed control 23 in this case. The motor of the suction blower 16 can, therefore, again be adjusted at its rpm as desired.

If an inductive load, as the already described electric brush 9, is attached to the connector 5 of the wet cleaning apparatus 1, this will be detected by the load detector 21. Accordingly, it transfers a signal 26 to the speed control 23. By this signal 26 the rpm is adjusted to maximum speed. The motor control 24 receives a corresponding signal so that the motor of the suction blower 16 of the wet cleaning apparatus 1 runs at maximum rpm as long as the inductive load 9 is attached.

Figure 3:
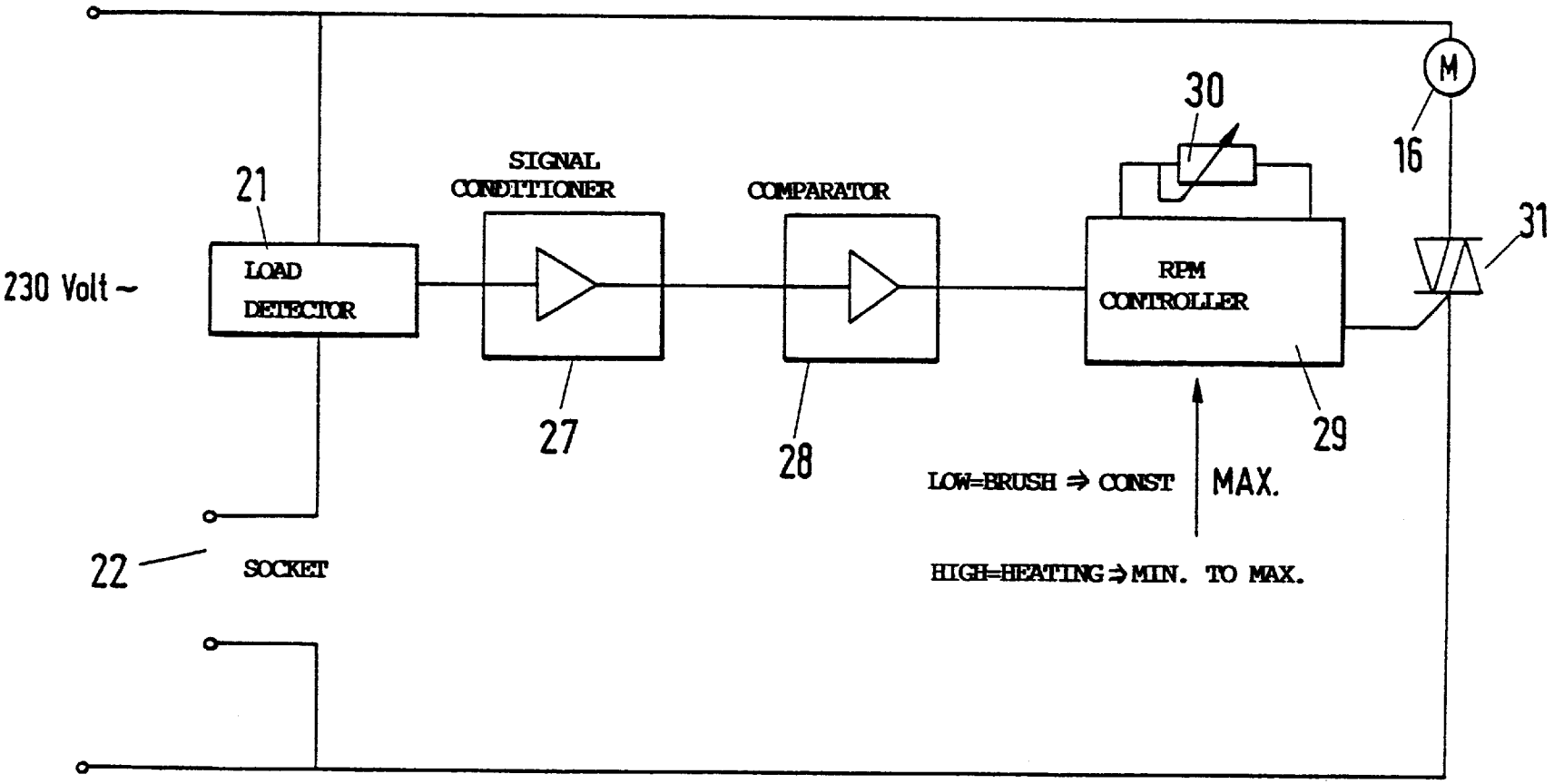
FIG. 3 shows a wiring diagram of the inventive control unit.

As the wiring diagram according to FIG. 3 shows, a signal conditioner 27 is arranged downstream of the load detector 21. The signal conditioner 27 conditions the signals produced depending on the devices attached to the socket 22 and it sends them to a comparator 28. If the signal sent by the signal conditioner 27 is a low signal, then an inductive load, as the earlier described electric brush 9, is attached to the socket 22. The rpm controller 29 which is arranged downstream of the comparator 28 and is a part of the speed control 23, receives a corresponding signal by which a potentiometer 30 of the rpm controller is adjusted such that the motor of the suction blower 16 is being driven at maximum the rpm. An electronic switching device 31, preferably an electronic power or current controller like a triac, is arranged between the rpm controller 29 and the motor of the suction blower 16. The current controller warrants that the motor of the suction blower 16 is driven at its maximum and constant rpm corresponding with the initial signal of the rpm controller.

When the inductive load is removed from the socket 22 or, in the case of the electric brush 9, when its electric motor 14 is turned off, no load is any longer attached to the socket 22. This is detected by the load detector 21 which sends a corresponding signal to the comparator 28 via the signal conditioner 27. The comparator 28 sends a high signal to the rpm controller 29, the potentiometer 30 of which is accordingly adjusted to a minimum rpm or a preset rpm so that the motor of the suction blower 16 is only driven at the minimum or preset rpm.

When a heating device, i.e., a resistive load, is plugged into the socket 22, in this case a high signal is also being sent from the comparator 28 to the rpm controller 29 so that also in this constellation the motor of the suction blower 16 of the wet cleaning apparatus 1 is adjusted to a minimum or a preset rpm.

In the event of a resistive load at the socket 22, or in the event of no load, the control unit 15 can also be embodied such that the motor of the suction blower 16 can be adjusted to a prior preset rpm which lies above the minimum rpm.

The control unit 15 is therefore capable of automatically determining the kind of device attached to the connector 5. If this is an inductive load, as an electric brush 9, the rpm of the motor of the suction blower 16 of the wet cleaning apparatus 1 is adjusted to the minimum rpm or, depending on the design of the control unit, to an accordingly decreased rpm when the device is turned off. As soon as the inductive load 9 is turned on, the motor of the suction blower 16 will be driven constantly at its highest rpm.

However, if a resistive load, as a heating device, is attached to the plug 22, the user of the wet cleaning apparatus 1 can adjust the rpm of the motor of the suction blower 16 as he desires and depending on what is required. In order to accomplish this, a switch or slide is provided at the wet cleaning apparatus 1. The desired rpm can then be manually adjusted by using this switch or slide. The electric and/or electronic control unit 15, respectively, its load detector 21, automatically determines, according to the desired operation, the power of the accessory device attached to the connector 5 and adjusts the power of the wet cleaning apparatus 1 accordingly.

This automatic power adjustment has been described with the help of the electric brush 9. When the electric brush 9 is turned on the motor of the suction blower 16 of the wet cleaning apparatus 1 is being driven at a constant maximum rpm. It is also possible to adjust the power of the motor of the suction blower 16 corresponding to the area to be cleaned. It is well-known that a higher suction power is required for cleaning a thick carpet than for cleaning a thinner carpet. In that case, the control unit 15 can be adjusted such that the rpm of the motor of the suction blower 16 is adjusted accordingly.

The specification incorporates by reference the disclosure of German priority document 198 13 434.7 of Mar. 27, 1998.

The present invention is, of course, in no way restricted to the specific disclosure of the specification and drawings, but also encompasses any modifications within the scope of the appended claims.

What is claimed is:

1. A wet cleaning apparatus to which accessory devices can be attached, said wet cleaning apparatus comprising:

a housing (4) having a connector (5) for attachment of an accessory device to effect cleaning;

a suction blower (16) disposed in said housing (4); and a control unit (15) disposed in said housing (4) for automatically adjusting the power of said suction blower (16) in accordance with the presence or absence of an accessory device or with an operational state of the accessory device, wherein said control unit (15) comprises a load detector (21) for detecting the drawing of current from the accessory device (9) detecting which type of the accessory device (9) and an operational state thereof which is connected to said wet cleaning apparatus, and wherein said control unit (15) further comprises a speed control (23) controlling the speed of said suction blower (16) as a function of the presence or absence of the accessory device, or the operational state thereof, wherein said speed control (23) is arranged downstream of said load detector (21).

2. A wet cleaning apparatus according to claim 1, wherein said control unit (15) automatically adjusts the power of said suction blower (16) when the attached accessory device (9) is in an on operational state.

3. A wet cleaning apparatus according to claim 1, wherein said control unit (15) shuts down said suction blower (16) when the attached accessory device (9) is in an off operational state.

4. A wet cleaning apparatus according to claim 1, wherein said control unit (15) decreases the power of said suction blower (16) when the attached accessory device (9) is in an off operational state.

5. A wet cleaning apparatus according to claim 4, wherein said control unit (15) decreases the power of said suction blower (16) to a minimum.

6. A wet cleaning apparatus according to claim 1, wherein said control unit (15) further comprises a motor control (24) for said suction blower (16), wherein said speed control (23) has a rpm controller (29) supplying an output signal for controlling said motor control (24).

7. A wet cleaning apparatus according to claim 6, wherein said speed control (23) adjusts said motor control (24) as a function of a preset rpm.

8. A wet cleaning apparatus according to claim 1, wherein said control unit (15) has a comparator (28), wherein said load detector (21) sends signals to said comparator (28), and wherein said comparator (28) sends a control signal, corresponding to the attached accessory device (9), to said speed control (23).

9. A wet cleaning apparatus according to claim 6, wherein said motor control (24) is equipped with an electronic switch (31).

* * * * *